US011097437B2

(12) United States Patent
Fuerst et al.

(10) Patent No.: US 11,097,437 B2
(45) Date of Patent: Aug. 24, 2021

(54) PERSONAL CARE DEVICE

(71) Applicant: Braun GmbH, Kronberg (DE)

(72) Inventors: Stefan Fuerst, Kronberg (DE); Reinhold Eichhorn, Idstein (DE); Martin Fuellgrabe, Bad Camberg (DE); Johannes Julian Weinkauff, Frankfurt am Main (DE); Christian Neyer, Eschborn (DE)

(73) Assignee: Braun GMBH, Kronberg (DE)

( * ) Notice: Subject to any disclaimer, the term of this patent is extended or adjusted under 35 U.S.C. 154(b) by 0 days.

(21) Appl. No.: 16/364,682

(22) Filed: Mar. 26, 2019

(65) Prior Publication Data

US 2019/0299434 A1 Oct. 3, 2019

(30) Foreign Application Priority Data

Mar. 27, 2018 (EP) ..... 18164335

(51) Int. Cl.
*B26B 19/38* (2006.01)
*A45D 26/00* (2006.01)
(Continued)

(52) U.S. Cl.
CPC ..... *B26B 19/388* (2013.01); *A45D 26/0057* (2013.01); *B26B 19/046* (2013.01);
(Continued)

(58) Field of Classification Search
CPC ... B26B 19/38; B26B 19/3806; B26B 19/382; B26B 19/386; B26B 19/3873; B26B 19/388; B26B 19/3886; B26B 19/00; B26B 19/02; B26B 19/04; B26B 19/046; B26B 19/048; B26B 19/06; B26B 19/063; B26B 19/10; B26B 19/12; B26B 19/145; B26B 19/146; B26B 19/26; B26B 19/265; A45D 2026/008
See application file for complete search history.

(56) References Cited

U.S. PATENT DOCUMENTS 4,930,217 A 6/1990 Wolf et al.
5,189,792 A 3/1993 Otsuka et al.
(Continued)

FOREIGN PATENT DOCUMENTS

CN 1018016 A 12/1990
CN 1688420 A 10/2005
(Continued)

OTHER PUBLICATIONS

European search report dated Jul. 18, 2018.
(Continued)

*Primary Examiner* — Evan H MacFarlane
(74) *Attorney, Agent, or Firm* — Kevin C. Johnson; Gerd Zetterer

(57) ABSTRACT

A device such as an electric shaver includes a working head attached to a handle for moving the working head along a skin surface, wherein at least one working tool is moveable relative to the handle under a skin contact pressure by a support structure to allow for pivoting of the working head's skin contact contour relative to the handle, wherein a biasing device is provided for biasing the working tool.

10 Claims, 4 Drawing Sheets

(51) Int. Cl.
*B26B 19/06* (2006.01)
*B26B 19/04* (2006.01)

(52) U.S. Cl.
CPC ..... *B26B 19/063* (2013.01); *B26B 19/386* (2013.01); *A45D 2026/008* (2013.01); *B26B 19/048* (2013.01); *B26B 19/3886* (2013.01)

(56) References Cited

U.S. PATENT DOCUMENTS

| | | | | |
|---|---|---|---|---|
| 5,257,456 | A | 11/1993 | Franke et al. | |
| 5,687,481 | A * | 11/1997 | De Boer | B26B 19/14 30/43.1 |
| 5,745,995 | A | 5/1998 | Yamashita et al. | |
| 6,568,083 | B1 * | 5/2003 | Taniguchi | B26B 19/048 30/43.1 |
| 6,826,835 | B1 | 12/2004 | Wong | |
| 7,364,052 | B2 | 4/2008 | Spatafora | |
| 7,832,104 | B2 | 11/2010 | Yamasaki et al. | |
| 8,667,692 | B2 | 3/2014 | Kraus | |
| 10,179,418 | B2 | 1/2019 | Hendriks et al. | |
| 10,576,647 | B2 | 3/2020 | Uit De Bulten et al. | |
| 2001/0025421 | A1 * | 10/2001 | Damstra | B25F 5/00 30/43.6 |
| 2002/0088121 | A1 | 7/2002 | Jacobsen | |
| 2004/0098862 | A1 | 5/2004 | Orloff | |
| 2004/0231160 | A1 * | 11/2004 | Shiba | B26B 19/046 30/43.92 |
| 2005/0216035 | A1 * | 9/2005 | Kraus | B26B 19/10 606/133 |
| 2007/0252338 | A1 | 11/2007 | Maier et al. | |
| 2008/0034591 | A1 | 2/2008 | Fung | |
| 2008/0196258 | A1 | 8/2008 | Kraus | |
| 2009/0000126 | A1 | 1/2009 | Kraus | |
| 2009/0056141 | A1 | 3/2009 | Barry et al. | |
| 2009/0119923 | A1 | 5/2009 | Hart et al. | |
| 2010/0186234 | A1 | 7/2010 | Binder | |
| 2011/0094102 | A1 | 4/2011 | Guan et al. | |
| 2011/0094107 | A1 | 4/2011 | Ring et al. | |
| 2011/0197726 | A1 * | 8/2011 | Kraus | B26B 19/046 83/13 |
| 2013/0025078 | A1 | 1/2013 | Heil et al. | |
| 2013/0097873 | A1 * | 4/2013 | Luo | B23D 21/00 30/92 |
| 2015/0020658 | A1 | 1/2015 | Eljaouhari | |
| 2015/0032128 | A1 | 1/2015 | Tavlin et al. | |
| 2015/0197016 | A1 | 7/2015 | Krenik | |
| 2016/0167241 | A1 | 6/2016 | Goldfarb et al. | |
| 2017/0097758 | A1 | 4/2017 | Bauer et al. | |
| 2017/0099199 | A1 | 4/2017 | Bauer | |
| 2017/0172278 | A1 * | 6/2017 | Mehaddene | A45D 26/0038 |
| 2017/0291319 | A1 * | 10/2017 | Hendriks | B26B 19/388 |
| 2017/0340085 | A1 * | 11/2017 | Kindermann | A45D 26/00 |
| 2018/0000219 | A1 | 1/2018 | Roenneberg et al. | |
| 2018/0236675 | A1 | 8/2018 | Westerhof et al. | |
| 2018/0243929 | A1 | 8/2018 | Takechi et al. | |
| 2019/0015998 | A1 | 1/2019 | Neyer et al. | |
| 2019/0061183 | A1 | 2/2019 | Neyer et al. | |
| 2019/0090999 | A1 | 3/2019 | Vetter et al. | |
| 2019/0126500 | A1 | 5/2019 | Wu | |
| 2019/0224869 | A1 | 7/2019 | Robinson et al. | |
| 2019/0299432 | A1 | 10/2019 | Fuerst et al. | |
| 2019/0299435 | A1 | 10/2019 | Fuellgrabe et al. | |
| 2019/0299436 | A1 | 10/2019 | Fuellgrabe et al. | |
| 2019/0299437 | A1 | 10/2019 | Fuellgrabe et al. | |
| 2019/0306259 | A1 | 10/2019 | Burghardt et al. | |
| 2020/0156272 | A1 | 5/2020 | De Vries et al. | |

FOREIGN PATENT DOCUMENTS

| | | | |
|---|---|---|---|
| CN | 202106393 | U | 1/2012 |
| CN | 203197960 | U | 9/2013 |
| CN | 104185537 | A | 12/2014 |
| CN | 204431302 | U | 7/2015 |
| CN | 105835093 | A | 8/2016 |
| CN | 105899336 | A | 8/2016 |
| CN | 106407935 | A | 2/2017 |
| CN | 106778618 | A | 5/2017 |
| CN | 107107351 | A | 8/2017 |
| CN | 107414902 | A | 12/2017 |
| CN | 107627329 | A | 1/2018 |
| CN | 107718059 | A | 2/2018 |
| CN | 107073727 | B | 8/2019 |
| CN | 110303526 | A | 10/2019 |
| CN | 110303531 | A | 10/2019 |
| CN | 110303532 | A | 10/2019 |
| CN | 110303533 | A | 10/2019 |
| DE | 10246519 | A1 | 4/2004 |
| DE | 102005045713 | A1 | 3/2007 |
| DE | 102006004675 | A1 | 8/2007 |
| DE | 102008031132 | A1 | 1/2010 |
| DE | 102010023681 | A1 | 12/2011 |
| EP | 0720523 | B1 | 8/1998 |
| EP | 1165294 | B1 | 6/2003 |
| EP | 1854593 | B1 | 6/2010 |
| EP | 1549468 | B1 | 11/2011 |
| EP | 3197649 | B1 | 8/2017 |
| EP | 3546150 | A1 | 10/2019 |
| EP | 3546151 | A1 | 10/2019 |
| EP | 3546152 | A1 | 10/2019 |
| EP | 3546153 | A1 | 10/2019 |
| JP | S5737472 | A2 | 3/1982 |
| JP | S5877445 | A | 5/1983 |
| JP | S5877445 | U | 5/1983 |
| JP | S59184778 | U | 12/1984 |
| JP | H6335575 | A | 12/1988 |
| JP | H04195302 | A | 7/1992 |
| JP | H06086873 | A | 3/1994 |
| JP | 08152902 | A | 6/1996 |
| JP | 08187376 | A | 7/1996 |
| JP | H9101804 | A | 4/1997 |
| JP | 2000507139 | A | 6/2000 |
| JP | 2000508570 | A | 7/2000 |
| JP | 2003009937 | A | 1/2003 |
| JP | 2004130153 | A | 4/2004 |
| JP | 2006501911 | A | 1/2006 |
| JP | 2006255335 | A | 9/2006 |
| JP | 2008043426 | A | 2/2008 |
| JP | 2008307132 | A | 12/2008 |
| JP | 2009508606 | A | 3/2009 |
| JP | 2009525090 | A | 7/2009 |
| JP | 2010227223 | A | 10/2010 |
| JP | 2010227224 | A | 10/2010 |
| JP | 2011526168 | A | 10/2011 |
| JP | 2012527939 | A | 11/2012 |
| JP | 2016077464 | A | 5/2016 |
| JP | 2016534805 | A | 11/2016 |
| JP | 2017526492 | A | 9/2017 |
| JP | 2017529168 | A | 10/2017 |
| JP | 2017536948 | A | 12/2017 |
| JP | 2018503420 | A | 2/2018 |
| JP | 2018532481 | A | 11/2018 |
| JP | 2019171033 | A | 10/2019 |
| JP | 2019171049 | A | 10/2019 |
| JP | 2019171051 | A | 10/2019 |
| JP | 2019171060 | A | 10/2019 |
| WO | 2001013757 | A1 | 3/2001 |
| WO | 2007033729 | A1 | 3/2007 |
| WO | 2014091719 | A1 | 6/2014 |
| WO | 2015067498 | A1 | 5/2015 |
| WO | 2016094327 | A1 | 6/2016 |
| WO | 2016096581 | A1 | 6/2016 |
| WO | 2017032547 | A1 | 3/2017 |
| WO | 2017062326 | A1 | 4/2017 |
| WO | 2018002755 | A1 | 1/2018 |

OTHER PUBLICATIONS

Search Report; Japanese Patent Application No. 2019-047272; dated Apr. 16, 2020; Japanese Patent Office; Japan.

First Search; Chinese Patent Application No. 2019102297388; dated Jun. 18, 2020; The State Intellectual Property Office of People's Republic of China; Beijing, China.

(56) References Cited

OTHER PUBLICATIONS

Chakravorty, Tanushri article dated Oct. 28, 2016; "How Machine Learning Works; An Overview;" obtained from https://thenewstack.io/how-machine-learning-works-an-overview; accessed Oct. 5, 2020.
Smuts, Jacques article dated Nov. 29, 2016; "Tutorial on Filters in Control Systems;" obtained from https://blog.opticontrols.com/archives/1319; accessed Oct. 5, 2020.
Boukhalfa, Sofiane article dated May 2017; "IoT and AI Combine to Dominate Consumer Electronics;" obtained from https://www.prescouter.com/2017/05/iot-ai-consumer-electronics/: accessed Oct. 5, 2020.
European Opinion and Search Report dated Dec. 14, 2018; EP Application No. 18164344; European Patent Office; Munich, Germany.
European Opinion and Search Report dated Jul. 11, 2018; EP Application No. 18164341; European Patent Office; Munich, Germany.
European Opinion and Search Report dated Jul. 16, 2018; EP Application No. 18164369; European Patent Office; Munich, Germany.
European Opinion and Search Report dated Jul. 18, 2018; EP Application No. 18164337; European Patent Office; Munich, Germany.
European Opinion and Search Report dated Jul. 9, 2018; EP Application No. 18164343; European Patent Office; Munich, Germany.
Japan Search Report dated Apr. 22, 2020; Japan Application No. 2019047272; Japan Patent Office; Tokyo, Japan.
Japan Search Report dated Apr. 23, 2020; Japan Application No. 2019044483; Japan Patent Office; Tokyo, Japan.
Japan Search Report dated Jul. 20, 2020; Japan Application No. 2019052815; Japan Patent Office; Tokyo, Japan.
Japan Search Report dated Jun. 26, 2020; Japan Application No. 2019052818; Japan Patent Office; Tokyo, Japan.
Japan Search Report dated Jun. 26, 2020; Japan Application No. 2019053167; Japan Patent Office; Tokyo, Japan.
Davies, Samuel Allen; Restriction/Election Requirement; U.S. Appl. No. 16/364,713; dated Jun. 19, 2020; U.S. Patent and Trademark Office; Alexandria, Virginia.
Patel, Bharat C.; Restriction/Election Requirement; U.S. Appl. No. 16/364,739; dated May 27, 2020; U.S. Patent and Trademark Office; Alexandria, Virginia.
Bermudez-Chacon, Roger et al article dated 2015; "Automatic problem-specific hyperparameter optimization and model selection for supervised machine learning: Technical Report;" obtained from https://www.research-collection.ethz.ch/bitstream/handle/20.500.11850/107673/eth-48308-01.pdf; accessed Oct. 5, 2020.
First Search dated Aug. 31, 2020; Chinese Application No. 2019102249740; Chinese National Intellectual Property Administration; Beijing, China.
First Search dated Jun. 20, 2020; Chinese Application No. 201902309169; Chinese National Intellectual Property Administration; Beijing, China.
First Search dated Aug. 7, 2020; Chinese Application No. 2019102349429; Chinese National Intellectual Property Administration; Beijing, China.
First Search dated Aug. 17, 2020; Chinese Application No. 2019102349433; Chinese National Intellectual Property Administration; Beijing, China.
First Search dated Aug. 26, 2020; Chinese Application No. 2019102349467; Chinese National Intellectual Property Administration; Beijing, China.
All Office Actions, U.S. Appl. No. 16/364,739.
All Office Actions, U.S. Appl. No. 16/364,753.
All Office Actions, U.S. Appl. No. 16/364,699.
All Office Actions, U.S. Appl. No. 16/364,713.
All Office Actions, U.S. Appl. No. 16/364,731.

* cited by examiner

PERSONAL CARE DEVICE

FIELD OF THE INVENTION

The present invention relates to a personal care device, in particular hair removal device such as electric shaver, comprising a working head attached to a handle for moving the working head along a skin surface, said working head including at least one working tool defining a skin contact contour of the working head, wherein said at least one working tool is movable relative to said handle under a skin contact pressure by means of a support structure to allow for pivoting of the working head's skin contact contour relative to the handle, wherein a biasing device is provided for biasing said working tool. The invention also relates to a method of controlling such personal care device.

BACKGROUND OF THE INVENTION

Hair removal devices such as epilators, beard trimmers and electric shavers usually have one or more cutter elements driven by an electric drive unit in an oscillating manner where the cutter elements reciprocate under a shear foil, wherein such cutter elements or undercutters may have an elongated shape and may reciprocate along their longitudinal axis. Other types of electric shavers use rotatory cutter elements which may be driven in an oscillating or a continuous manner Said electric drive unit may include an electric motor or an electric-type linear motor, wherein the drive unit may include a drive train having elements such as an elongated drive transmitter for transmitting the driving motion of the motor to the cutter element, wherein the motor may be received within the handle portion of the shaver or in the alternative, in the shaver head thereof.

Although such shavers are used on a daily basis by most users, it is sometimes difficult to operate and handle the shaver indeed perfectly. Due to different preferences and habits of different users, often the shaver is not operated in its optimum range. For example, the working head with the cutter elements may be pressed against the skin too strongly, or the shaver may be held at an orientation preventing the working head's shear foils from full contact with the skin, even if the working head is pivotably supported to compensate for some angular displacement.

For example, it is well known in the field of shavers to movably suspend the shaver head to allow the cutter elements to self-adjust their position and orientation to better follow the skin contour. More particularly, the shaver head may be pivotably supported to pivot about one or two or more pivot axes extending transverse to the longitudinal axis of the handle so the working surface of the shaver head may stay in full contact to the skin contour even when the handle is held at a "wrong" orientation. Furthermore, the cutter elements may float or dive into the shaver head structure so as to compensate for or react on excessive forces pressing the shaver head against the skin.

Document EP 0 720 523 B1 discloses an electric shaving apparatus which allows for adjusting the height over which the cutter elements project from the shaver head surface, adjusting the pretensioning force of the cutter blades against which pretensioning force the cutter blades may dive, and adjusting the motor speed so as to balance shaving performance and skin irritation. Said adjustable parameters are automatically controlled by fuzzy logic to balance the influence of the different input signals indicative of the different working parameters but, the achieved self-adjustment of the shaver is still insufficient in terms of fitting different user's needs and different user's preferences.

EP 1165294 A1 discloses an electric shaver having a sensor supplying a signal representing grip exerted by a user onto the handle to control motor speed.

Furthermore, WO 2016/094327 A1 discloses an electric shaver that is equipped with a number of sensors including a force sensor which measures skin contact force.

EP 1549468 B1 describes a shaver which detects proper contact of the shear foils with the skin to be shaved, wherein it is mentioned that such contact may be detected by means of an inductive sensor, a capacitance sensor or an optical sensor which may include a light barrier immediately above the shear foil. It is suggested to automatically vary the position of the shaver head relative to the handle by means of an actuator for pivoting or tilting the shaver head, when there is improper contact to the skin.

SUMMARY OF THE INVENTION

It is an objective underlying the present invention to provide for an improved personal care device in particular a hair removal device such as a shaver or epilator avoiding at least one of the disadvantages of the prior art and/or further developing the existing solutions. A more particular objective underlying the invention is to provide for an improved self-adjustment of the personal care device to the user.

A further objective underlying the invention is to allow for easy self-adaption of the working tools of the working head to complex skin contours over a wide range together with a gentle treatment of the skin, but still providing for a good feeling of control when pressing the working head against a skin portion to achieve thorough treatment.

At least one of the aforementioned objectives is achieved by the features of the claim 1. Advantageous embodiments are provided by the features of the sub-claims.

To achieve at least one of the aforementioned objectives, it is suggested to adjust stiffness of the working head's skin contact contour relative to the handle, wherein an adjustment actuator is configured to adjust the pivoting and/or floating stiffness of the working head's suspension and/or the resistance and/or unwillingness of the working head against pivoting and/or floating movements so as to give the personal care device a more aggressive, performance-oriented handling on the one hand and a more comfortable, smoother handling on the other hand, depending on the user's behavior. According to an aspect, an adjustment device including an adjustment actuator is controlled by an electronic control unit to adjust pivoting and/or floating stiffness of the working head in response to at least one characteristic treatment parameter detected by at least one detector (as described below in more detail) during handling the personal care device when effecting the personal care treatment.

More particularly, the adjustment mechanism may vary the torque and/or force necessary to pivot the skin contact contour of the working head relative to the handle and/or to achieve a certain pivot angle of the skin contact contour of the working head deviating from a neutral position thereof. Such adjustment of the pivoting stiffness may be automatically controlled by the control unit in response to at least one characteristic treatment parameter detected during a treatment session by a detector providing a signal indicative of such characteristic treatment parameter to said control unit. In particular, pivoting stiffness and/or floating stiffness of the working head may be adjusted in response to skin pressure with which the working head's skin contact contour is pressed against the skin of a user, wherein such skin pressure can be detected by a suitable skin pressure sensor. When a user of a shaver, for example, wants a particular close shave, the user usually presses the shaver head stronger against the skin, wherein the user may get the impression that the shaver head pivots too easily. Thus, when detecting an increased skin pressure, the adjustment mechanism may increase the pivoting stiffness.

On the other hand, when the skin pressure sensor detects the pressure of the working head against the skin is decreasing and/or the user only slightly presses the shaver head against the skin, the control unit may actuate the adjustment actuator, in response to a sensor signal indicating such low skin contact pressure, to reduce stiffness of the working tool and/or working head suspension to allow for easier pivoting of the skin contact contour of the working head. Thus, the user gets the impression the working head is more flexible and may easier adapt to varying skin contours and skin surface orientations when gently treating the skin to avoid skin irritation. Working tool or working head "stiffness" or "pivoting stiffness" means and refers here and hereinabove and below to the degree of resistance with which the working tool or working head may move or swivel or pivot. This stiffness may be adjusted relative to the device handle and/or relative to other parts of the working head, e.g. one hair cutting unit as a working tool of an electric dry shaver movability resistance or non-resistance relative to the shaver handle and/or relative to other cutting units also provided in the working head of the shaver device or this could may be adjusted by the movability resistance or non-resistance of the complete e.g. shaver working head or a wing bearing some cutting units/hair cutters of the working head relative to the shaver handle or relative to the other wing of the working head provided with further cutting units/hair cutters.

Said sensor signal indicative of skin pressure may represent real time data and skin pressure variations occurring during a current treatment session so the personal care device provides for a quick response to variation of the user's handling.

So as to achieve the desired variation of the working head's and/or working tool's stiffness relative to pivoting and/or floating movements, the adjustment actuator may vary the setting of the biasing device providing for a biasing force and/or torque in order to adjust the movability resistance of the movable working head. Preferably but not necessarily the biasing force of the biasing device also urges the movable elements of the working head and/or the complete working head into a neutral position with the working head's skin contact contour in a neutral position. More particularly, the adjustment actuator may adjust the biasing device to provide for an increased biasing force and/or increased biasing torque and/or resisting force/torque to achieve increased stiffness, or on the other hand, to reduce biasing force and/or biasing torque and/or resisting force/torque to achieve a reduced stiffness. This may also include a zero stiffness or maximum swivel or movability of the working head which may be achieved by e.g. inactivating the biasing device. Said biasing device or pivot resistance controller may e.g. also include a brake or damper or other device that causes a resistance to rotation/pivoting/movement of the working tool and/or working head.

For example, said biasing device may include at least one spring element applying a spring force onto the working head and/or the working tool against which spring force the working tool may move to allow for pivoting of the skin contact contour, wherein the adjustment actuator may increase and decrease the pretentioning of such spring so as to adjust the stiffness of the working head structure.

In addition or in the alternative to such spring device, the working head may include at least one damper to dampen movements of the working head relative to the handle and/or of the working tool relative to a working head frame, wherein such damper may be adjusted by the adjustment actuator to provide for less dampening action or more dampening action to decrease and increase stiffness of the working head.

In addition or in the alternative to such spring device, the working head may include at least one braking device to dampen or brake the movements of the working head relative to the handle and/or of the working tool relative to a working head frame, wherein such braker may be adjusted by the adjustment actuator to provide for less braking action or more braking action to decrease and increase stiffness of the working head.

It is also an objective to provide an improved method of controlling a personal care device and in particular a hair removal device such as a shaver or epilator.

These and other advantages become more apparent from the following description giving reference to the drawings and possible examples.

DETAILED DESCRIPTION OF THE INVENTION

Figure 1:
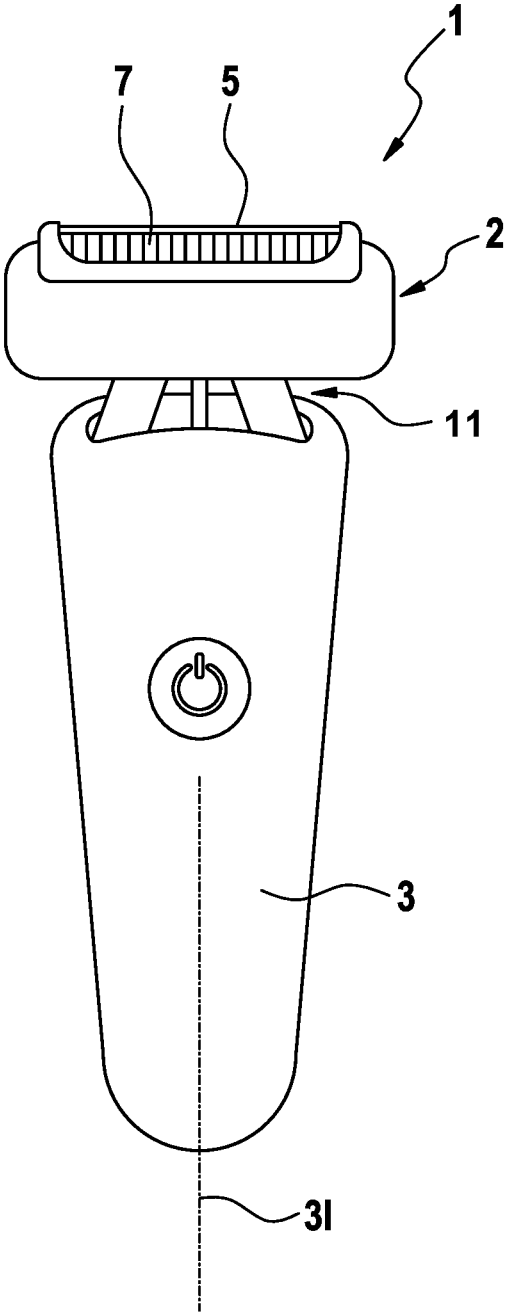
FIG. 1: a perspective view of a personal care device in terms of an electric shaver comprising a handle and a shaver head pivotably connected thereto, wherein pivoting stiffness of the shaver head and diving or floating resistance of the cutter elements may be adjusted in response to user behavior.

So as to achieve easy self-adaption of the working tools of the working head to complex skin contours over a wide range together with a gentle treatment of the skin, but still providing for a good feeling of control when pressing the working head against a skin portion to achieve thorough treatment, it is suggested to adjust stiffness of the working head's skin contact contour relative to the handle, wherein an adjustment actuator is configured to adjust the pivoting and/or floating stiffness of the working head's skin contact contours defined by the at least one working tool so as to give the personal care device a more aggressive, performance-oriented handling on the one hand and a more comfortable, smoother handling on the other hand, depending on the user's behavior. According to an aspect, an adjustment device including an adjustment actuator is controlled by an electronic control unit to adjust pivoting and/or floating stiffness of the working head in response to at least one characteristic treatment parameter detected by at least one detector during handling the personal care device when effecting the personal care treatment.

Such adjustment of the pivoting stiffness may be automatically controlled by the control unit in response to at least one characteristic treatment parameter detected during a treatment session by a detector providing a realtime signal indicative of such characteristic treatment parameter to said control unit. In particular, pivoting stiffness of the working head may be adjusted in response to skin pressure with which the working head and/or the treatment tool thereof is pressed against the skin of a user, wherein such skin pressure can be detected by a suitable skin pressure sensor. When a user of a shaver, for example, wants a particularly close shave, the user usually presses the shaver head stronger against the skin, wherein the user may get the impression that the shaver head pivots too easily. Thus, when detecting an increased skin pressure, the adjustment mechanism may increase the pivoting stiffness.

On the other hand, when the skin pressure sensor detects the pressure of the working head against the skin is decreasing and/or the user only slightly presses the shaver head against the skin, the control unit may actuate the adjustment actuator, in response to a sensor signal indicating such low skin contact pressure, to reduce stiffness of the working tool and/or working head suspension to allow for easier pivoting of the skin contact contour of the working head. Thus, the user gets the impression the working head is more flexible and may easier adapt to varying skin contours and skin surface orientations when gently treating the skin to avoid skin irritation.

Said sensor signal indicative of skin pressure may represent real time data and skin pressure variations occurring during a current treatment session so the personal care device provides for a quick response to variation of the user's handling.

Such skin pressure detector may include a capacitive or resistive touch sensor or other force measuring sensor may be used to detect skin contact force between a skin surface and the working head and/or cutting parts of a shaver head, and/or the force on each cutting element and distribution across the different elements. In addition or in the alternative, at least one detector such as a force sensor, which may be configured 1-dimensional, 2-dimensional, or 3-dimensional, may detect a resultant direction that the user is pressing the device against the skin. In addition or in the alternative, at least one detector such as hall sensor may detect movements of parts of the device relatively to each other due to external forces. In addition or in the alternative, at least one detector such as motor current based detection systems may determine skin contact force.

So as to achieve the desired variation of the working head's and/or working tool's stiffness relative to pivoting and/or floating movements, the adjustment actuator may vary the setting of the biasing device providing for a biasing force and/or biasing torque and/or resisting force/torque in order to adjust the movability resistance of the movable working head. Preferably but not necessarily the biasing force of the biasing device also urges the movable elements of the working head into a neutral or otherwise predetermined position with the working head's skin contact contour in a neutral or predetermined position. More particularly, the adjustment actuator may adjust the biasing device to provide for an increased biasing force and/or increased biasing torque and/or resisting force/torque to achieve increased stiffness, or on the other hand, to reduce biasing force and/or biasing torque and/or resisting force/torque to achieve a reduced stiffness. Those adjustments may affect the working head as a whole, just one working tool (or hair cutting unit) or at least one working tool or hair cutting unit relative to others provided on the working head. Such groups of one or more working tools/hair cutters may be e.g. implemented by a wing structure having one or more hair cutters in one wing and one or more hair cutters in the other wing and each wing may be pivotally supported relative to the other and relative to the handle.

For example, said biasing device may include at least one spring element applying a spring force onto the working head and/or the working tool against which spring force the working tool may move to allow for pivoting of the skin contact contour, wherein the adjustment actuator may increase and decrease the pretentioning of such spring so as to adjust the stiffness of the working head structure.

In addition or in the alternative to such spring device, the working head may include at least one damper or braking device to dampen or brake movements of the working head relative to the handle and/or of the working tool relative to a working head frame, wherein such damper or braking device may be adjusted by the adjustment actuator to provide for less dampening/braking action or more dampening/braking action to decrease and increase stiffness of the working head.

The kinematics of the support structure may have different configurations. For example, there may be only one pivot axis about which the entire working head may pivot relative to the handle. In the alternative, the support structure may allow for multi-axial pivoting, wherein a swivel axis and a tilt axis extending substantially perpendicular to each other and parallel to an enveloping plane to the working head's skin contact contour when considering the working head in a neutral position.

In addition or in the alternative, the at least one hair removal tool may pivot and dive or float relative to a working head frame and/or relative to other hair removal tools as far as provided.

More particularly, different levels of pivoting may be available to the at least one hair removal tool. According to a further aspect, the at least one hair removal tool is movably supported relative to a working head frame or part of a working head frame, and said working head frame may be pivotably supported relative to the handle to allow for pivoting of the skin contact contour relative to the handle, wherein the support structure and the biasing device are configured to allow for pivoting of the working head frame about one or more pivot axes relative to the handle and to allow for pivoting of the skin contact contour relative to said working head frame about one or more pivot axes parallel to the aforementioned pivot axes by means of moving the at least one working tool relative to the working head frame. Due to the multiple degrees of freedom of the working head and the working tools thereof, there may be different pivoting responses to forces applied onto the working head and/or the working tools thereof.

The biasing device may include separate biasing elements for biasing the working tools relative to the working head frame, wherein such biasing elements try to avoid diving and/or floating of the working tools relative to the working head frame and/or urge the working tools into a neutral position in which the tools have a maximum height relative to the working head frame.

On the other hand, the biasing device may include a biasing element for biasing the working head frame into a neutral angular position relative to handle.

The adjustment actuator may change the setting of one of said biasing elements or of both biasing elements so as to adjust biasing forces and biasing torque and/or resisting force/torque onto the working head frame relative to the handle and onto the working tool relative to said working frame so as to increase and decrease pivoting stiffness of the working head frame and floating stiffness of the working tool, thereby adjusting pivoting stiffness of the skin contact contour.

Pivoting and/or floating stiffness may be adjusted by the adjustment actuator during a treatment session in response to one or more other characteristic treatment parameters selected from the group of parameters comprising velocity at which the personal care device is moved along a body portion to be treated, frequency of strokes, angular orientation of the personal care device relative to the gravitational field and position of fingers gripping the handle and position of the working head relative to the body to be treated.

For example, when a user moves the personal care device at high velocities over the body portion to be treated and/or at a high stroke frequency, the user may need quicker pivoting of the working head and thus less pivoting stiffness so the adjustment mechanism may decrease pivoting stiffness in response to an increase in velocity and/or stroke frequency as detected by a corresponding sensor.

In addition or in the alternative, the adjustment mechanism may increase pivoting stiffness when a change of the finger grip position on the handle is detected and/or a change of the angular orientation of the handle and/or angular rotation of the handle is detected what indicates the user is adapting to the device, when, for example, a user is shaving a neck portion. Typically, when shaving the neck area, a user will rotate the shaver around the longitudinal axis of the handle and change the finger grip position such that the shaver's front side points away from the user. Additionally, the user then rotates the shaver around an axis parallel to the swivel axis of the shaver head. Based on detection of such grip position, the adjustment mechanism may increase the pivoting stiffness.

In addition or in the alternative, pivoting and/or floating stiffness may be adjusted in response to other parameters such as environmental parameters. For example, at least one environmental detector may detect air humidity and/or air temperature, wherein the pivoting stiffness and/or floating stiffness and/or cutter speed and/or cutter frequency may be adjusted in response to detected air humidity and/or air temperature.

In the alternative or in addition, the pivoting stiffness may be adjusted in response to a physiological parameter of the user which may be detected by a suitable physiological detector. For example, density and/or length of hairs on a skin portion to be shaved may be detected by a visual or optical sensor such as a camera. Furthermore, skin moisture or skin oiliness may be detected to adjust one of the aforementioned working parameters such as pivoting stiffness.

The adjustment mechanism also may be configured to adjust the angular pivoting range of the working head to allow a larger or smaller maximum angular displacement, wherein such adjustment of the maximum angular displacement may be varied automatically during a treatment session in response to any one or more of the afore-mentioned parameters as detected by a corresponding detector or as may be adjusted via user input, e.g. directly on the shaver or via an external device such as a smart phone. The personal care device will give a more aggressive, performance-oriented feeling to the user when the maximum available pivoting angle is smaller, whereas a more comfortable, smoother feeling is provided with a larger maximum pivoting angle.

For example, a pivot range adjustment device may be provided for adjusting the pivot angle about which the skin contact contour is pivotable relative to the handle, to have a first setting in which said angle a is less than +/−35° and more than +/−2° and a second setting in which said angle a is less than +/−25° and more than +/−2° with said second setting different from said first setting. In prior art shavers, it is known to lock the shaver head so it may no longer pivot relative to the handle. This is also possible for the working head of the present hair removal device. However, in addition to such locking, the aforementioned pivot range adjustment means that the maximum pivot angle can be set to have different values each of which are different from 0. In other words, the maximum pivot angle may be set to assume a large value and to have a smaller value still larger than 0. For example, in said first setting the angle a may be less than +/−30° and more than +/−20° and in said second setting the angle a may be less than +/−20° and more than +/−2°.

The pivot range adjustment device may be configured to allow for a continuous adjustment of the maximum pivot angle over a certain range. For example, when the maximum pivot angle may be adjusted over a range from +/−2° to +/−20°, continuous adjustment means that any value between −2° and +20° can be set for the maximum allowed pivot angle. Such continuous adjustment allows for fine adaption to the user's needs. In addition or in the alternative, the pivot range adjustment device may be configured to allow for a stepwise adjustment of the maximum pivot angle, wherein such stepwise adjustment may include at least three steps from, e.g., +/−5° to +/−10° to +/−20°. Such stepwise adjustment allows for a quicker setting and leads to quicker recognition of a variation of the pivot range. The minimum adjustment range above noted (in this para and the one para above this paragraph) as +/−2° could be instead also +/−3° or +/−4° or +/−5°.

These and other features become more apparent from the example showing in the drawings. As can be seen from FIG. 1, the personal care device may be configured as an electric shaver 1 comprising a handle 3, wherein in the interior of the handle 3 a drive unit including an electric motor M powered by a battery B and an electronic control unit may be accommodated. Such handle 3 may have an elongated, substantially bone-shaped configuration extending along a longitudinal axis 31.

An ON-OFF switch or power switch may be arranged at the handle 3. By means of such power switch, the drive unit may be started and switched off again. The shaver 1 may further include a display which may be provided on the handle 3, for example on a front side thereof. Such display may be a touch display device allowing individual setting preferences to be input, wherein, the shaver 1 may include further input elements in terms of, for example, a touchbutton which may be positioned in the neighborhood of the power switch.

At one end of said handle 3, a working head 2 may be mounted to said handle 3, wherein the working head 2 may be movably supported at said handle 3. For example, the support structure 11 supporting the working head 2 at the handle 3 may allow for one-axial or multi-axial pivot and/or swiveling movements of the entire working head 2 relative to the handle 3.

In addition to such basic movability, the working head 2 may allow for a sort of internal movements. More particularly, the working head 2 includes a plurality of hair removal tools 4 which may include a pair of short hair cutters 5 and 6 and a trimmer 7 which are supported movably relative to a working head base structure.

More particularly, the working head 2 may include a support frame or working head frame 12 which may be pivotably supported at the handle 3 about at least one pivot axis 8 to allow for pivoting movements of the support frame 12 and thus, of the working head 2 as a whole relative to the handle 3.

Said pivot axis 8 may extend parallel to a first plane separating the short hair cutters 5 and 6 from each other and parallel to a second plane extending substantially perpendicular to the aforementioned longitudinal axis 31 of handle 3.

Figure 3:
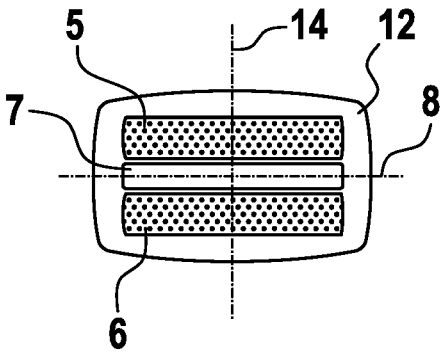
FIG. 3: a schematic top view of the working head of FIG. 2 showing said pair of short hair cutters and said trimmer therebetween.

As can be seen from FIG. 3, the aforementioned short hair cutters 5 and 6 and the aforementioned trimmer 7 may have an elongated, substantially block-like shape and/or an elongated, substantially rectangular shape, wherein the short hair cutters 5 and 6 may include a flexible mesh screen with a curved surface under which an undercutter and/or cutter blade block may reciprocate. On the other hand, the trimmer 7 may include a pair of sickle finger bars reciprocating relative to each other and/or an apertured foil with relatively large apertures under which an undercutter with cutting blades may reciprocate.

Due to the aforementioned elongated shape of the short hair cutters and trimmers the skin contact surface of the working head 2 formed by the top surfaces of the aforementioned short hair cutters 5 and 6 and trimmer 7 may have a strip-like configuration and as a whole, may have a rectangular configuration when viewed from the top.

Figure 2:
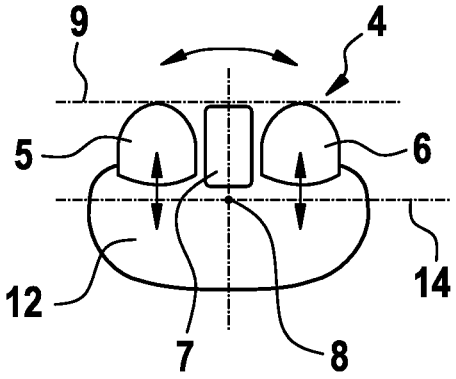
FIG. 2: a schematic side view of the working head of the shaver of FIG. 1 showing a pair of short hair cutters and a trimmer therebetween.

Said hair removal tools 4 in terms of the short hair cutters 5 and 6 and the trimmer 7 may float relative to the working head frame 12 and thus, dive into the working head tool substantially along a direction perpendicular to the skin contact contour 9, at least when considering such skin contact contour 9 in a neutral or initial position as shown by FIG. 2. Since each hair removal tool 4 may float or dive individually, the skin contact contour 9 may pivot when one of the hair removal tools 4 dives and another one does not dive. In particular, when under asymmetric skin pressure one of the short hair cutters 5 is diving, whereas the other one is not diving, the skin contact contour 9 pivots about an axis substantially parallel to the aforementioned pivot axis 8.

As can be seen from FIG. 3, multi-axial pivoting is possible, wherein a second pivot axis 14 may extend substantially perpendicular to the aforementioned first pivot axis 8. Pivoting about such second pivot axis 14 also may be carried out on different levels, i.e. the support structure 11 may allow for pivoting of the working head frame 12 about such second axis 14 and/or the hair removal tools 4 may float and/or dive relative to the working head frame 12 in an asymmetric manner such that the hair removal tools 4 pivot about such second axis 14 relative to the working head frame 12.

Due to the multiple degrees of freedom of the working head 2 and the hair removal tools 4 thereof, there may be different pivoting responses to forces applied onto the working head 2 and/or the hair removal tools 4 thereof.

Depending on biasing device 10, more particularly the biasing forces and/or biasing torques and/or resisting force/torque applied onto the hair removal tools 4 and/or onto the working head frame 12, a force applied onto one of the hair removal tools 4 may result in pivoting of the working head frame 12 and/or pivoting of the skin contact contour 9 due to diving of the hair removal tools 4.

Said biasing device 10 may include separate biasing elements 10*a* for biasing the hair removal tools 4 relative to the working head frame 12, wherein such biasing elements 10*a* try to avoid diving and/or floating of the hair removal tools 4 relative to the working head frame 12 and/or urge the hair removal tools 4 into a neutral position in which the tools 4 have a maximum height relative to the working head frame 12. On the other hand, the biasing device 10 may include a biasing element 10*b* for biasing the working head frame 12 into a neutral angular position relative to handle 3.

An adjustment device may change the pivoting stiffness of the shaver head 2 as will be described in detail. Such adjustment device may include one or more adjustment actuators AA such as electric motors or electric actors or actors of other types using other forms of energy such as magnetic actors. Such adjustment actuators may be controlled by a control unit 80, wherein such control unit 80 may include an electronic control unit, in particular a micro-controller working on the basis of software stored in a memory. On the basis of the detected parameters, the device may be adjusted in different ways. More particularly, a control algorithm of the control unit 80 may set the control output signals to control the adjustment actuators AA in accordance with a calculation rule and/or on the basis of a curve and/or a map implemented in said electronic control unit 80, for example in a memory device to which a micro-controller has access.

Such adjustment actuator AA may adjust the setting of the aforementioned biasing device 10 so as to increase and/or decrease the biasing force and/or biasing torque and/or resisting force/torque of said biasing device, wherein the actuator AA may adjust only one of the aforementioned biasing elements 10*a* and 10*b* or both biasing elements 10*a* and 10*b* so as to adjust the biasing of the working tools relative to the working head frame and the biasing of the working head frame relative to the handle 3.

The adjustment actuator AA may be controlled by the control unit 80 in response to skin contact pressure detecting during a shaving session in terms of real time data.

Figure 4:
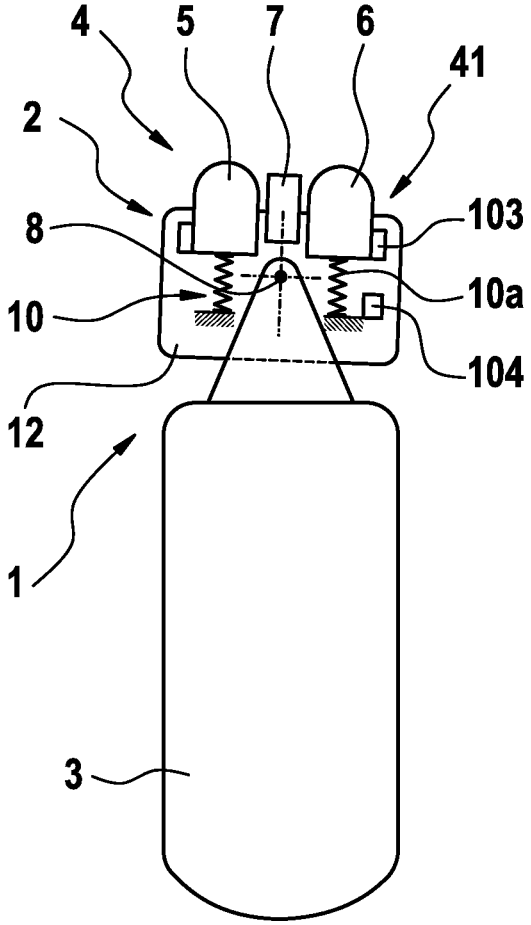
FIG. 4: a schematic side view of the shaver of the preceding figures showing a detector for detecting individual diving of the cutter elements to determine shaving pressure.
Figure 5:
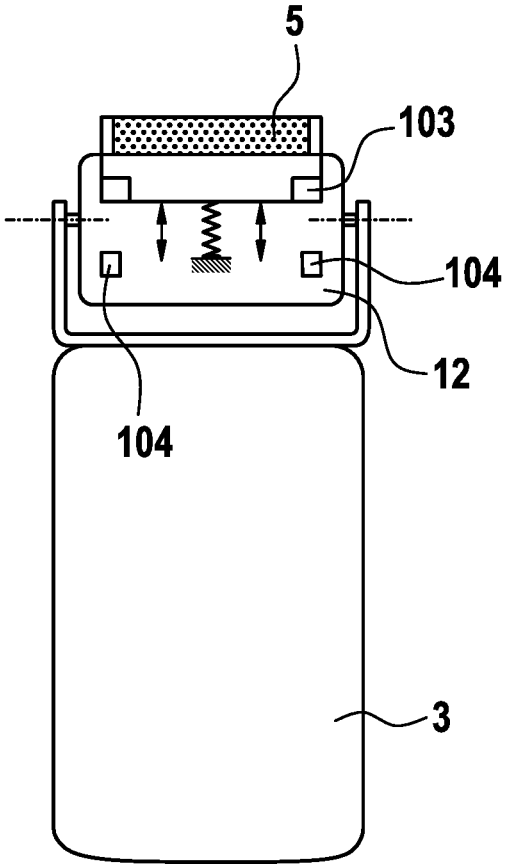
FIG. 5: a schematic front views of the shaver of FIG. 4 with a detector for detecting individual diving of the cutter elements to determine shaving pressure according to a further embodiment.

More particularly, the shaver 1 with working head 2 is equipped with pressure sensor 41 and a sensor that detects directions and speed of motion. One or more cutting elements 4 are spring loaded and carry small magnets 103, cf. FIGS. 4 and 5. The higher the shaving pressure, the more the cutting elements 4 are pressed down. This movement is tracked via hall sensors 104 under each cutting element. The hall sensors are connected to the electronic control unit 80 on the internal PCB of the shaver. Mounted on the PCB may be an accelerometer to detect acceleration of preferably all three axes or at least one or more axes of the device.

The electronic control unit 80 receives the signals of the hall sensors 104 and the accelerometer. A mathematic function translates the signals into pressure and movement data. E.g. the consumer starts to apply higher shaving pressure than typical the cutting elements 4 are moving deeper into the shaving head 3. Or the movements are faster and shorter. The electronic control unit 80 receives these signals from the hall sensors 104 and the accelerometer and translates it to pressure and movement values. These values are compared with a given matrix of values in real time within the control unit 80 and evaluated to generate the assigned signal for the actuator AA.

Figure 6:
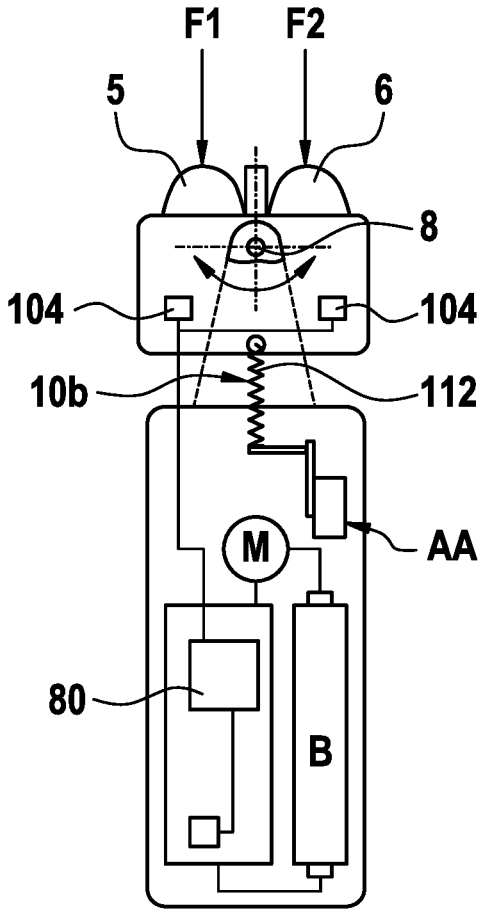
FIG. 6: a schematic side view of the shaver similar to FIG. 4 showing the adjustment mechanism for adjusting pivoting stiffness and the detector for detecting diving or floating.
Figure 7:
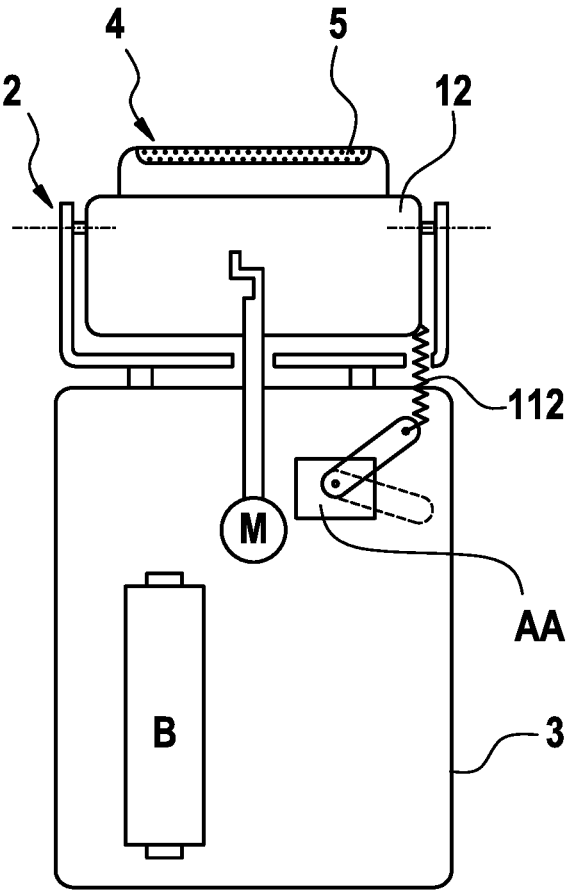
FIG. 7: a schematic side view of the shaver similar to FIG. 5 showing the adjustment mechanism for adjusting pivoting stiffness and the detector for detecting diving or floating.

Basically, when asymmetric shaving pressure is applied to the shaving system—means more pressure F1 on one of the short hair cutters 5 than F2 on the other—a torque occurs and the shaving head 2 swings around its axis (8) to align on facial contours. The counterforce of the working head 2 is minimized to ensure a good adaptation of the shaving system even when low pressure is applied. The aforementioned biasing device 10 may include a pulling spring 112 mounted between the lower end of the head 2 and the shaver body 3, cf. FIGS. 6 and 7. The spring 112 sets the force to swing the head 2. The stronger the spring is set the harder the head can swing.

Actuator AA is attached to the shaver body and holds the end of the spring. It can set the pre-load of the spring 112 by changing the length of the spring. In neutral actuator position the spring has the lowest pre-load and the swing head can swing very easy. At maximum actuation the spring is pulled tight and the shaving head needs more shaving pressure to get moved. The consumer feels a more stiff and rigid system. The actuator can set the spring load step-less between min. and max. actuation position.

According to a still further embodiment, the user may be requested to enter data directly e.g. via a smart phone or another device or directly into the shaver in order to provide the algorithm with additional data. This may be a one-time input e.g. after purchase or be requested on a regular basis, wherein such input may be affected, for example, by voice and voice recognition. This input can then be used to adjust the setting of the biasing means to set the desired stiffness of the working head.

According to a further aspect, high air humidity leads to sticky skin which means that the frictional forces between skin and shaving foils/trimmers are increased. This leads to a phenomenon called "stick-slip-effect" where the shaver alternately slips easy over the skin or sticks to the skin. This makes shaving more difficult and uncomfortable. Users react in a variety of ways to this, typically they may adapt their behavior to the product-environment situation by reducing the shaving pressure they use. As however a general reduction in shaving pressure can have multiple causes, in this situation an additional air humidity sensor could be used in order that the control unit 80 can identify the appropriate shaver adjustment for this specific situation, such as increasing the pivoting stiffness of the working head 2 to reduce the uncontrolled swiveling of the head caused by the stick-slip. In other words, actuator AA may increase the biasing force of spring 112 when high air humidity is detected by a humidity detector.

Optionally the adjustment device is configured for adjusting pivoting and/or diving stiffness of the working head and/or of the working tool for effecting the personal care treatment in response to a signal of at least one of the following detectors:

- a touch detector for detecting contact of the working head with a user's body,
- a velocity and/or acceleration detector for detecting velocity and/or acceleration of the personal care device,
- a rotation detector for detecting rotation and/or orientation of the personal care device in three or one or two dimensions,
- a stroke speed and/or stroke length detector for detecting a stroke speed and/or stroke length,
- a stroke density detector for detecting the number of strokes over a predetermined area of the body portion to be treated,
- a distance detector for detecting the distance of the personal care device and/or of the user from a mirror,
- a detector for detecting pauses in the personal care treatment,
- an angle sensor for detecting a change in angle of the working head to a user's face and/or a change in angle of the handle to a user's face and/or a change in angle of a handle to a user's hand or arm,
- a grip detector for detecting a change in the type of grip such of fingers on the handle,
- a contact detector for detecting a contact area between the shaver head and the user's face and/or a change in said contact area,
- a hair detector for detecting hair density and/or hair length,
- an environmental detector for detecting air humidity and/or air temperature,
- a displacement detector for detecting linear and/or rotatory displacement of the working head relative to the handle,
- a cutting activity detector for detecting cutting activity of the personal care device,
- a trimmer position detector for detecting a position of a medium and/or long hair trimmer,
- a skin moisture detector for detecting the moisture of the skin,
- a skin oiliness detector for detecting the oiliness of the skin
- a skin contact force detector for detecting the skin contact force indicative of the applied force between the personal care device and the skin.

Further optionally a sensitivity controller is provided for adjusting the sensitivity with which the degree of a pivoting and/or floating stiffness of at least part of the working head 2 in response to at least one characteristic treatment parameter detected by at least one detector 41 during handling the personal care device when effecting the personal care treatment is adjusted. Said sensitivity is adjusted in response to a measured skin contact force with which the device is pressed against the skin and/or said sensitivity is adjusted in response to predefined skin contact force and or in response to threshold values at which the pivoting stiffness changes. The sensitivity adjustment may be automatic or by user input at the shaver or at an external device which is wireless connected with the shaver as e.g. a smartphone.

It is to be noted that the features hair cutter, short hair cutter, trimmer, cutting unit can be exchangeably considered in the above. Furthermore all described here in the context of a linear oscillating working tool may be also applied to a rotary type moving working tool.

It is to be further noted that in the above +/− values° for certain angle values° mean that the complete angel range is 2*value°, so e.g. +/−20° refers to an angular range of 2*20°=40°. Moreover a +/− value° does not necessarily relate to a midpoint of the range in the middle of the range the midpoint or neutral/predetermined position of the working head may be also at the outer extremes of the range or somewhere within the range as long as the working head or working tool pivots within the range.

The invention claimed is:

1. A personal care device comprising a working head attached to a handle for moving the working head along a skin surface, said working head including at least one working tool defining a skin contact contour of the working head, wherein said at least one working tool is moveable relative to said handle via a support structure to allow for pivoting of the working head relative to the handle, wherein a biasing device is provided for biasing and for increasing pivotal movement resistance of said working head relative to the handle, wherein an adjustment device including an adjustment actuator is provided to adjust the biasing device to adjust a pivoting stiffness of at least part of the working head relative to the handle, wherein the adjustment actuator is controlled by an electronic control unit to adjust the pivoting stiffness of the at least part of the working head in response to at least one characteristic treatment parameter detected by at least one detector during handling of the personal care device when effecting a personal care treatment, wherein said at least one detector includes a skin contact pressure sensor for detecting a skin contact pressure of the working head against the skin surface, wherein the control unit is configured to control the adjustment actuator in response to a signal of said skin contact pressure sensor indicative of the skin contact pressure of the working head against the skin surface, wherein the control unit is configured to actuate the adjustment actuator such that the pivoting stiffness of the at least part of the working head is increased in response to the signal of the skin contact pressure sensor indicating that the skin contact pressure is increasing, and the pivoting stiffness of the at least part of the working head is decreased in response to the signal of the skin contact pressure sensor indicating that the skin contact pressure is decreasing.

2. The personal care device according to claim 1, wherein said biasing device includes at least one biasing element for biasing said at least one working tool relative to a working head frame and at least one further biasing element for biasing the working head frame relative to the handle, the skin contact pressure sensor comprises a displacement sensor for detecting displacement of the at least one working tool relative to the working head frame against a biasing torque of the at least one biasing element, wherein the control unit is configured to actuate the adjustment actuator in response to a signal of said displacement sensor to adjust a biasing torque of the at least one further biasing element for biasing the working head frame relative to the handle.

3. The personal care device according to claim 1, wherein said biasing device is also provided for biasing said at least one working tool into a neutral position in the absence of the skin contact pressure.

4. The personal care device according to claim 1, wherein the adjustment device including the adjustment actuator controlled by the electronic control unit is provided to adjust also a floating stiffness.

5. The personal care device according to claim 1, wherein the control unit is configured to continuously actuate the adjustment actuator to continuously adjust the pivoting stiffness of the at least part of the working head in response to the skin contact pressure which is detected in real time during a personal care session.

6. The personal care device according to claim 1, wherein the control unit is configured to stepwise actuate the adjustment actuator to stepwise adjust the pivoting stiffness of the at least part of the working head in response to the skin contact pressure which is detected in real time during a personal care session.

7. The personal care device according to claim 1, wherein said at least one working tool is movably supported relative to a working head frame, and said working head frame is pivotably supported relative to the handle about at least one pivot axis, wherein said biasing device includes at least one biasing element for biasing said at least one working tool relative to the working head frame and at least a further biasing element for biasing the working head frame relative to the handle about said at least one pivot axis.

8. The personal care device according to claim 7, wherein the adjustment actuator is coupled to the biasing device to adjust a biasing torque of at least one of said biasing elements.

9. The personal care device according to claim 7, wherein the control unit is configured to increase the pivoting stiffness of the at least part of the working head frame relative to the handle when diving of said at least one working tool relative to the working head frame increases, and wherein the control unit is configured to decrease the pivoting stiffness of the at least part of the working head frame relative to the handle when diving of said at least one working tool relative to the working head frame decreases.

10. A method for controlling a personal care device comprising the following steps:

detecting a skin contact pressure of a working head against a skin surface by a skin contact pressure sensor during handling of the personal care device when effecting a personal care treatment to a body surface, characterized by adjusting a pivoting stiffness of at least part of the working head relative to a handle of the personal care device in response to the skin contact pressure by an adjustment actuator controlled by an electronic control unit during the personal care treatment, wherein the control unit is configured to actuate the adjustment actuator such that the pivoting stiffness of the at least part of the working head is increased in response to a signal of the skin contact pressure sensor indicating that the skin contact pressure is increasing, and the pivoting stiffness of the at least part of the working head is decreased in response to the signal of the skin contact pressure sensor indicating that the skin contact pressure is decreasing.

* * * * *